United States Patent [19]

Chap

[11] Patent Number: 4,915,248

[45] Date of Patent: Apr. 10, 1990

[54] BASKET ASSEMBLY WITH STORAGE MEANS

[75] Inventor: John P. Chap, Lemont, Ill.

[73] Assignee: Selfix, Inc., Chicago, Ill.

[21] Appl. No.: 139,989

[22] Filed: Dec. 31, 1987

[51] Int. Cl.[4] ..... A63B 55/04

[52] U.S. Cl. ..... 220/19; 220/8

[58] Field of Search ..... 220/19, 4A, 8, 18, 8

[56] References Cited

U.S. PATENT DOCUMENTS

| | | | |
|---|---|---|---|
| 2,103,885 | 12/1937 | Whalen | 220/19 X |
| 2,889,924 | 6/1959 | Paulucci | 220/8 X |
| 2,979,242 | 4/1961 | Van Huis et al. | 220/19 X |
| 3,420,483 | 1/1969 | Stalker | 220/19 X |
| 4,723,743 | 2/1988 | Jenkins | 220/19 X |

*Primary Examiner*—Steven M. Pollard

*Attorney, Agent, or Firm*—Dressler, Goldsmith, Shore, Sutker & Milnamow, Ltd.

[57] ABSTRACT

A basket assembly including a first wire structure defining a basket and a second wire structure translatable toward and away from the first wire structure for defining an article support or receptacle. The second wire structure is coupled to the first wire structure through C-shaped attachments captively arranged along and about a bottom section of the first wire structure for permitting movement toward and away from the basket.

4 Claims, 1 Drawing Sheet

BASKET ASSEMBLY WITH STORAGE MEANS

FIELD OF THE INVENTION

This invention relates to baskets and, more particularly, to a basket arrangement formed from plastic-coated wires.

BACKGROUND OF THE INVENTION

Plastic-coated metal wire devices have become very popular consumer items. These types of goods are available in a wide variety of configurations including shelves, racks, baskets and like arrangements which facilitate convenient storage of articles where desired. The preferred plastic coating on these types of products provides an attractive, durable, corrosion-resistant finish which permits these types of products to be used in a myriad of locations throughout the home.

Basket-like coated wire products have proven particularly useful. Some basket arrangements typically include interconnected coated wire members which define a basket having an open side and are supported or hung from a shelf. An example of such a basket may be found in U.S. Pat. No. 4,456,125 to J. P. Chap.

Other types of basket arrangements are used as a receptacle for a removable bag. Moreover, some basket arrangements have been known to provide storage means, such as outwardly extending pockets, arranged in combination with the basket. Such pockets may be provided as an integral part of the basket or may be removably attached thereto. Additional or replacement bags may be stored in such pockets, thus adding convenience for the user.

While providing convenience, such additional storage means also present certain drawbacks. Those storage means which are removably attached to the basket often become separated therefrom and are ultimately lost. Those storage means which are permanently affixed to the basket also suffer drawbacks. That is, such storage means may extend outward in a stationary fashion from the basket. As such, the overall size of the packaging for such baskets is significantly increased. An increase in package sizing presents further problems in shipping and storing of such articles. That is, the increased size in packaging is further reflected in increased shipping size and decreased storage capacity and, thus, a decreased capacity in retail display room.

Heretofore, no known basket arrangement has been configured to provide additional storage without adding significant size to both the overall size of the basket and the packaging for such baskets and, thus, a reduction in retail display area. Thus, introduction of a coated wire basket which provides additional storage without adding significant size to the basket, the packaging of such units, or a reduction in the retail display space for such units would answer customers' needs for convenience without imparting additional burdens on the manufacture and ultimate retailer.

SUMMARY OF THE INVENTION

In view of the above, and in accordance with the present invention, there is provided a two-piece, preferably plastic-coated wire basket assembly which factilitates convenient storage of additional bags. The basket assembly of the present invention is constructed to optimize package sizing without subtracting from the conveniences afforded customers.

The present basket assembly preferably comprises plastic-coated metal wire for ease of economical fabrication and for convenient, durable, and attractive use. The basket assembly includes a first wire structure formed from a plurality of spaced, interconnected elongated members defining an open-top basket having a front, two sides, and a bottom, and a second wire structure defining an article support which is coupled to and manually translatable toward and away from the basket structure. Because the article support structure is coupled to the basket structure, it will not readily be separated or lost therefrom. The second wire structure defines a one-piece article support or receptacle whose capacity is limited by the extent such structure is movable away from the basket. By such construction, the receptacle can provide an adjustably sized storage means, e.g., for additional bags, to be used in combination with the basket.

The article support structure is coupled to the basket structure in a manner allowing slidable movement therebetween but which securely retains the two structures together. As such, during shipping and subsequent use, the article support structure will not readily be separated from the basket structure. Moreover, the instant invention allows the second wire structure or storage means to be arranged close to the basket so as to not add significant size to the packaging and/or storage space consumed by the basket arrangement and enhances nestability of the basket assemblies. In use, such article support can be laterally moved away from the basket to provide a storage means for the additional bags. The basket assembly may further include handle means provided on the wire structure defining the basket. Such handle means provide a support for plastic bags whose upper ends may be encircled about such handle means for purposes of stability and convenience.

Numerous other advantages and features of the present invention will become readily apparent from the following detailed description of the invention and embodiment thereof, from the claims, and from the accompanying drawings.

DETAILED DESCRIPTION OF THE PRESENT INVENTION

Figure 2:
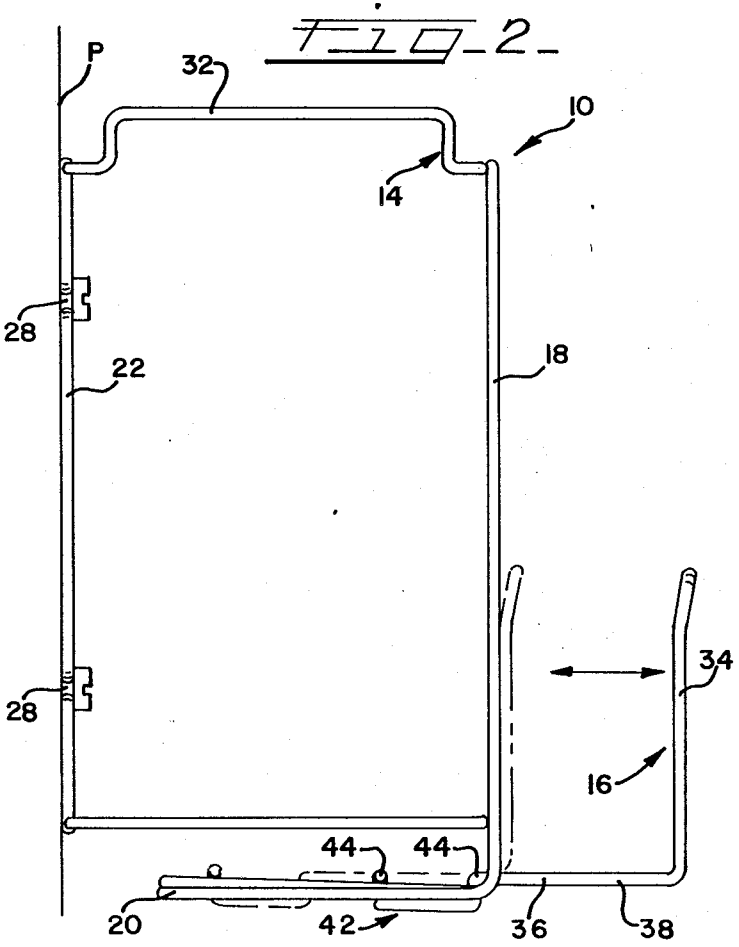
FIG. 2 is a side elevational view of the basket arrangement illustrated in FIG. 1.

While the present invention is susceptible to embodiment in various forms, there is shown in the drawings and will hereinafter be described a presently preferred embodiment with the understanding that the present disclosure is to be considered as an exemplification of the principles of the invention and is not intended to limit the invention to the embodiment illustrated.

Referring now to the drawings, wherein like reference numerals indicate like parts throughout the several views, there is shown an open-top basket assembly 10 adapted to receive and support a replaceable bag 12. The basket assembly 10 preferably comprises plastic-coated or plated metal wire members appropriately shaped to provide the basket with its desired configuration. The coating on the wires may comprise plastic, vinyl, or a like material which is suitably durable and corrosion-resistant and which is typically available in a wide variety of colors for enhancing the aesthetic appeal of the basket. The basket assembly may be fabricated in accordance with known methods typically comprising suitable interconnection of the various members of the basket by welding with the entire arrangement thereafter being plastic-coated or plated.

The basket assembly 10 includes a first wire structure 14 defining a basket and a second wire structure 16 coupled to but reciprocably translatable toward and away from the basket 14 and defining an article support or receptacle. As illustrated, the basket 14 includes a pair of generally U-shaped frame members 20, 21, generally defining, respectively, the upper and lower reaches of the basket 14. The frame members 20, 21 are generally vertically aligned and include base portion 20*a*, 21*a* lying in a plane defining the front of basket 14, first leg portions 20*b*, 21*b* lying in a plane defining one side of basket 14, and second leg portions 20*c*, 21*c* lying in a plane defining another side of the basket 14. A pair of mounting members 22, 24 extend between and are connected to the rear ends of leg portions 20*b*, 21*b* and 20*c*, 21*c*, respectively. The basket 14 includes a plurality of generally parallel, laterally spaced, elongated L-shaped wall members 25, 26, 27, 28. Each of the wall members 25, 26, 27, 28 includes a first front wall defining leg 25*a*, 26*a*, 27*a*, 28*a*. Each of the front wall legs 25*a*, 26*a*, 27*a*, 28*a* is attached to the base portions 20*a*, 21*a* of the frame members 20, 21, and extend below the frame member 21, at which point the wall members are bent to form integral, second, rearwardly extending bottom defining leg portions 25*b*, 26*b*, 27*b*, 28*b*. The rear ends of the bottom leg portions 25*b*, 28*b* of the outer wall members 25, 28 are interconnected by a rear bottom wall portion 29 formed integrally therewith. The rear ends of the bottom leg portions 26*b*, 27*b* of the inner wall members 26, 27 are attached to the rear bottom portion 29. As illustrated, the wall members 25, 26, 27, 28 are integral L-shaped members defining the front and bottom of the basket. It will be appreciated, however, that the front and bottom of the basket 14 could be defined by separate elements or members.

To facilitate attachment of the basket assembly 10 on a panel P (FIG. 2) or the like, the elongated side panel members or portions 22, 24 of the basket include suitable mounting means 29 disposed at vertically spaced locations along those wire elements defining the side sections of the basket. The mounting means 29 comprise one or more eyelets formed as an integral part of the side section. The eyelets permit the basket to be hung from supporting objects. The leg portions 20*b*, 20*c* of frame member 20 may also include upstruck handle sections or means 32. Such handle means 32 provide a support for the open loops or handles commonly provided on plastic bags or the like and which may be encircled thereabout.

As illustrated, the article support or receptacle 16 includes a one-piece wire structure having a pair of generally L-shaped members, each including a first front section 34 having legs 34*a*, 34*b*, and a top 34*c*. The front section 34 extends defining generally parallel to the front of the basket and a second bottom section 36 extending generally parallel to the bottom of the basket. Each of the second sections 36 includes a resiliently biased arm 36*a*, 36*b* extending parallel to, and adjacent to the leg portion 26*b* or 27*b*, respectively. Each arm 36*a*, 36*b* 36 has arranged proximate its free distal end operative or coupling means 42*a*, 42*b* for slidably and releasably attaching the article support 16 to the basket.

Figure 1:
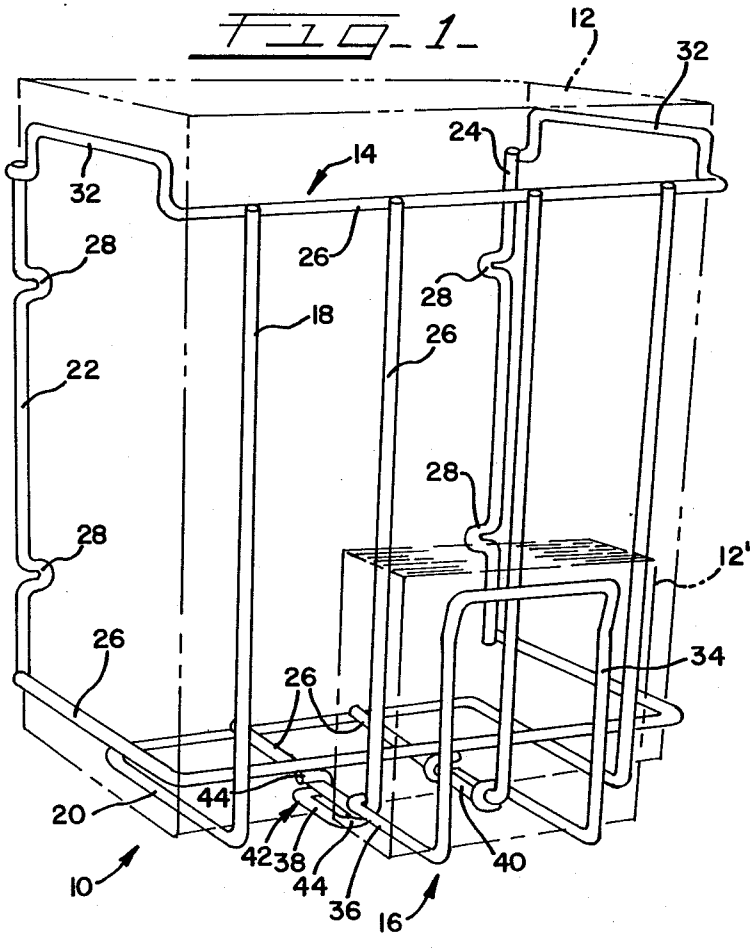
FIG. 1 is a perspective view illustrating a basket arrangement incorporating the teachings of the present invention.

Each slidable attachment means 42*a*, 42*b* comprises at least two interconnected C-shaped sections 44*a*, 44*b* connected by offset portion 45*a*, *45b* disposed below arm 36*a*, 36*b*, respectively. The attachment means 42*a*, 42*b* interact with the adjacent elongated members 26*b*, 27*b* defining part of the bottom panel to prevent inadvertent removal of the receptacle 16 from basket 14. As may be best illustrated in FIG. 1, each arm 36*a*, 36*b* extends substantially parallel and adjacent to one side of an elongated member defining the bottom panel. The C-shaped sections 44*a*, *44b* provided on each arm 36*a*, 36*b* captively extend around the adjacent member 26*b*, 27*b* in a manner allowing transverse movement of the receptacle but preventing inadvertent removal of the receptacle from the basket. At least one of these C-shaped sections limits the transverse movement of the article support away from the front section. As shown in FIG. 1, each arm 36*a*, 36*b* extends on one side of the corresponding frame member 26, 27, and the C-shaped sections 44*a*, 44*b* of the coupling means 42*a*, 42*b* extend around the other side of the bottom defining leg portions 26*b*, 27*b*. In this way, the coupling means, interacting only with the frame members to which they are attached, retain the article support 16 in place, preventing inadvertent removal thereof by engagement with only the frame members themselves. As may be best illustrated in FIG. 1, when the article support is extended away from the basket, the arms 38, 40 provide a transverse support for receiving and holding additional bags 12'.

Thus, a plastic-coated wire basket is disclosed which readily permits the insertion and support of a bag therein. In those instances where bags having handles or loops are used in conjunction with this invention, the handles of such a bag may be encircled about the handle means 32. Because bags for such basket arrangements are often replaced, the article support or receptacle 16 provides a convenient place to store and locate such additional bags. The unique structure of the article support means provides added benefits. First, such a receptacle allows replacement bags to be readily stored where they are needed. Second, the slidability of the receptacle toward and away from the basket optimized the storability of such a device by minimizing the overall package sizing for such a basket arrangement.

From the foregoing, it will be observed that numerous variations and modifications may be effected without departing from the true spirit and scope of the novel concept of the present invention. It will be understood that no limitation with respect to the specific apparatus illustrated herein is intended or should be inferred. It is, of course, intended to cover by the appended claims all such modifications as fall within the scope of the claims.

Thus having adequately described my invention, what I claim is:

1. A basket assembly adapted to be mounted on a support member comprising:

a plurality of spaced apart, interconnected, elongated, members defining a basket having a front, sides, and a bottom, including:

a pair of vertically spaced apart, generally U-shaped frames generally defining the upper and lower reaches of the front and sides of said basket, each of said U-shaped frames having a base portion interconnecting first and second leg portions, said base portions lying generally in a plane defining said front, said first leg portions lying generally in a plane defining one of said sides, and said second leg portions lying generally in a plane defining another of said sides, and a plurality of wall members defining the front and bottom of said basket, said wall members extending between and connected to said base portions of said frame members and having bottom defining leg portions lying generally in a plane transverse to the aforesaid front and side planes defined by said frame members and disposed between the aforesaid side planes; and one-piece article support means, said article support means including means integral therewith for coupling said article support means to said bottom defining leg portions of selected ones of said wall members, said coupling means interacting with said selected wall members to retain said article support means coupled to said leg portions, said article support means being reciprocably translatable with respect to said basket between a retracted position limited by engagement of said article support means with said front wall, and an extended position limited by the interaction of said coupling means with said selected ones of said wall members.

2. A basket assembly as claimed in claim 1, wherein said article support means includes at least two arms, and said coupling means being disposed at the free end and formed integrally with said arms for slidably attaching said article support means to said basket.

3. A basket assembly as claimed in claim 2, wherein each of said coupling means comprises a pair of interconnected C-shaped sections captively arranged along and about the said bottom defining leg portions of said wall members.

4. A basket assembly as claimed in claim 3, wherein said C-shaped sections extend around one side of said bottom defining leg portions, and said article support means arms pass adjacent the other side of the same frame member for inhibiting removal of said article support means from said basket.

* * * * *